United States Patent [19]

Balland

[11] 4,231,749

[45] Nov. 4, 1980

[54] DYEING PROCESS USING A SEQUESTRATING AGENT

[75] Inventor: Jean Balland, Chateaurenault, France

[73] Assignee: Manufacture de Produits Chimiques Protex Societe Anonyme, Paris, France

[21] Appl. No.: 33,010

[22] Filed: Apr. 24, 1979

Related U.S. Application Data

[63] Continuation of Ser. No. 817,797, Jul. 21, 1977, abandoned.

[30] Foreign Application Priority Data

Jul. 23, 1976 [FR] France ..... 76 23120

[51] Int. Cl.[3] ..... D06P 1/10; D06P 1/667

[52] U.S. Cl. ..... 8/584; 8/685

[58] Field of Search ..... 8/89 R, 86, 171, 42 C

[56] References Cited

U.S. PATENT DOCUMENTS

| | | | |
|---|---|---|---|
| 3,303,139 | 2/1967 | Blaser et al. | 252/180 |
| 3,366,676 | 1/1968 | Dyer | 260/502.4 |
| 3,400,149 | 9/1968 | Quimby et al. | 260/502.4 P |
| 3,621,081 | 11/1971 | Prentice | 252/175 |
| 3,645,670 | 2/1972 | Kowalski | 8/108 |
| 3,734,954 | 5/1973 | Maier | 260/502.4 P |
| 4,020,091 | 4/1977 | Budnick | 260/502.4 P |
| 4,126,412 | 11/1978 | Masson | 8/171 |

OTHER PUBLICATIONS

Millson, H. E., Amer. Dyestuff Reporter, Jan. 30, 1956, pp. 66–81.

*Primary Examiner*—Joseph L. Schofer
*Assistant Examiner*—Maria S. Tungol
*Attorney, Agent, or Firm*—Karl F. Ross

[57] ABSTRACT

Dyeing with a dyestuff containing a metal or from a bath in the presence of one or more metallic elements, especially alkaline-earth or heavy metals, is carried out in the presence of a sequestrating agent or sequestrant. According to the invention the sequestrant is a derivative of a phosphonic acid having no effect on the physical-chemical characteristics of the dyestuff which is used and is preferably a salt of a hydroxy-lower-alkane-phosphonic acid.

3 Claims, No Drawings

DYEING PROCESS USING A SEQUESTRATING AGENT

This is a continuation of application Ser. No. 817,797, filed July 21, 1977, now abandoned.

FIELD OF THE INVENTION

The present invention relates to fabric dyeing in the presence of a sequestrating agent or sequestrant and, more particularly, to the dyeing of textile fibers, webs and the like with a dye bath which contains an alkaline-earth or heavy metal intentionally or accidentally, and/or makes use of a dyestuff containing a metal element.

BACKGROUND OF THE INVENTION

It is known that certain dyestuffs, which otherwise are highly useful for the dyeing of textile fibers, are detrimentally affected by various metals, especially alkaline-earth metals or heavy metals such as iron and copper which constitute impurities introduced accidentally in the dyeing bath. These metals have the effect of causing agglomeration or flocculation of the dyestuff, modifications of tone and depth of color, a decrease in the transfer of dye to the textile fibers and a reduction in the fixation of the dyestuff to the fiber. In general, therefore, dyeing quality can be sharply reduced and dyeing efficiency lowered by the presence of alkaline-earth and heavy metal ions in the dyeing bath.

It has been proposed heretofore to reduce the effect of alkaline-earth metals and heavy metals upon the physical and coloring properties of a dyestuff by introducing into the dyeing bath one or more compounds having the properties of sequestrants, i.e. sequestrating agents capable of tying up and rendering ineffective the ions of alkaline-earth and heavy metals. Some compounds can be the polyphosphates of alkaline metals and aminopolycarboxylic acid derivatives.

These compounds, however, do not fully solve the problems mentioned above. In fact, in many cases they create new problems with certain dyestuffs. For example, these compounds have been found to possess a sequestrating action which applies to molecules of a dyestuff containing copper, chromium and like metals. When such dyestuffs are used, the aminopolycarboxylic acid derivatives can effect a demetallization of the dyestuff molecule and hence cause a significant modification of the nuance, tone and color of the dyeing. Such sequestrants have been found to detrimentally affect the stability of the dyestuff to light.

The number of dyestuffs, of various types, sensitive to the demetallization and sequestration action of the aminopolycarboxylic acid derivatives is sufficiently significant so that generally these sequestering agents are avoided entirely and polyphosphates are used in their stead.

While the use of polyphosphates of the aforedescribed type does not create a danger of demineralization of the dyestuff molecule and does not modify the dyeing or coloring characteristics of the dye, the sequestrating power of the polyphosphates vis-á-vis the heavy-metal ions, such as those of copper and iron, is relatively poor so that large concentrations of the polyphosphate compounds must be used. It is significant that the polyphosphate derivatives have a much lower sequestrating capability than the aminopolycarboxylic acid derivatives which are detrimental for the reasons previously set forth. Furthermore, the sequestrating power of the polyphosphates reduces with increasing dyeing temperature. Hence elevated dyeing temperatures must generally be avoided.

Consequently, while sequestrants of the aforedescribed type have been found to be useful in the presence of alkaline-earth metal ions and heavy metal ions, various problems have been encountered in their use so as to prevent widespread application of the sequestering technique using these types of compounds.

OBJECT OF THE INVENTION

It is the principal object of the present invention to provide an improved dyeing process of widespread applicability whereby the disadvantages of earlier systems can be avoided.

SUMMARY OF THE INVENTION

I have now found that the problems encountered heretofore of dyeing with dyestuffs containing metals or in the presence of alkaline-earth and heavy metals in the dyeing bath can be carried out effectively, without the disadvantages of the earlier systems, by the use of certain derivatives of phosphonic acid which have been found to be effective sequestrating agents for different metals. The use of these derivatives as sequestrants in a dyeing bath has been found to give rise to excellent sequestration of possible metallic impurities in the bath without any tendency toward demetallization of the dyestuff molecule and without adversely affecting any of the color characteristics thereof. Sequestrating effectiveness is not adversely affected by increased temperatures which permits the system to be used for the dyeing of synthetic fibers and mixtures containing synthetic fibers which can be dyed efficiently only at elevated temperatures.

The present invention, therefore, is a dyeing process for textile fibers in the presence of sequestrating agents which involves the addition to the dyeing bath of at least one derivative of phosphonic acid which forms a complex with metallic impurities contained in the bath but which does not demetallize the dyestuff or otherwise adversely affect the transfer of the dyestuff to the textile fibers.

The phosphonic acid derivatives which are used in the process of the present invention are salts of amino-lower-alkane-polyphosphonic acids and/or the salts of hydroxy-lower-alkane-phosphonic acids. The term "lower alkane" is used herein to refer to straight or branch-chain alkyl and alkenyl.

According to a feature of the invention, the amino-lower-alkane-phosphonic acids are hydrocarbon derivatives having $C_1$–$C_6$ hydrocarbon groups, of which the best results are obtained with aminomethanediphosphonic acid, amino-bis-methylene-phosphonic acid, diethylene-triaminopentakis-methylene-phosphonic acid, ethylene-diamine-tetrakis-methylene-phosphonic acid, 1-amino-methyl-cyclopentylamine-2-tetrakis-methylene-phosphonic acid, and 1,2-cyclohexane-tetrakis-methylene-phosphonic acid.

Of the hydroxy-lower-alkane phosphonic acids which may be used in the present invention, I prefer those which are $C_1$–$C_4$ hydrocarbon derivatives, especially hydroxy-ethane-1,1-diphosphonic acid or 1-hydroxypropane-1,1,3-triphosphonic acid.

Practically any dyestuff which has been susceptible heretofore to demetallization by a sequestrating agent can be used and generally the dyestuff bath is an aqueous system of any conventional type. The fibers which may be dyed are natural fibers such as cotton, wool and synthetic fibers dyeable by the particular dyestuff used.

The dyeing temperature may be any temperature conventional in the art and is preferably between 50° C. and the boiling point of the bath, the dyeing time ranging from five minutes to several hours. The dyestuff may be present in a quantity corresponding to 0.05% by weight of the material to be dyed to 10% by weight of the material to be dyed and I prefer to include in the dyeing bath sodium chloride in an amount ranging between 0.5% by weight of the material to 20% by weight of the material to be dyed. Other salts may also be present as desired.

The preferred dyestuffs of the present invention are: red disperse dye color index 92, blue direct color index 86, red reactive dye color index 7, orange dye color index 63, blue direct dye color index 81, black direct dye color index 71, green direct dye color index 34, blue direct dye color index 93, violet direct dye color index 47.

SPECIFIC EXAMPLES

EXAMPLE 1

A cotton fabric, previously boiled and bleached, is dyed under conventional conditions in a direct dye at a temperature of 98° C. for a period of sixty minutes with dye baths having the three formulas given below. The dyestuff was a direct dye known for its sensitivity to the sequestrating agents, namely, violet direct dye color index 47. In the three formulations, the actual dyeing bath is prepared with distilled water and the bath ratio (textile:bath) is 1:20.

Formulation A: Dyestuff 2% by weight of the material to be dyed;
NaCl 10% by weight of the material to be dyed.

Formulation B: Identical to A but further including 2% by weight of the material to be dyed of hydroxyethane-1,1-diphosphonic acid previously neutralized and brought to pH 7 with a solution of sodium hydroxide (the sequestrant is thus the sodium salt).

Formulation C: The same as A but also including 2% by weight of the material to be dyed of ethylenediaminetetracetic acid (EDTA) previously neutralized and brought to pH 7 with sodium hydroxide solution.

After dyeing the fabric, rinsing the dyed fabric with water and drying, the dyeing effect was examined with respect to stability toward light for samples dyed with the different formulations given above.

The sample obtained by Formulation B, i.e. in the presence of a derivative of a diphosphonic acid, showed no change either in the dyeing intensity or in the stability toward light from the results obtained by Formulation A. By contrast, the sample obtained with Formulation C shows a significant modification in the depth of dyeing and a change in color toward red as well as a decrease in the stability toward light of several points.

EXAMPLE 2

The conditions and formulations for dyeing were the same as in Example 1 but the comparative tests were carried out with the following direct dyes also known to be sensitive to EDTA-type sequestrants: blue direct dye color index 93, green direct dye color index 34, black direct dye color index 71, blue direct dye color index 86.

As in Example 1, no modification was observed in the presence of the phosphonic acid derivative. However, the dyeing carried out in the presence of EDTA showed a modification of shading, accompanied by instability of the dyed color to light. In all cases using the EDTA, there was a lack of trueness in the dyeing rendition.

EXAMPLE 3

The conditions of Example 1 were used with the dyestuffs employed in Example 2.

In Formulation B, however, the hydroxyethane-1,1-diphosphonic acid of Example 1 was replaced by the same amount of amino-tris-methylenephosphonic acid.

As in the preceding Examples, the use of this compound did not modify the coloration of the dye or cause a reduction in the stability of the color toward light.

EXAMPLE 4

Cotton fabric, boiled and bleached, was dyed with a direct dye in a dyeing bath prepared from distilled water which has a hardness obtained by the addition of 0.3 g of calcium chloride and 0.3 g of magnesium chloride.

A combination of direct dyes, known for their sensitivity to hard water, was used, namely, blue direct dye color index 81 and orange direct dye color index 63.

The treatment conditions were the following:

Formulation A

| | | |
|---|---|---|
| Blue direct dye color index 81 | 0.5% | by weight of |
| Orange direct dye color index 63 | 0.5% | material |
| NaCl | 10% | to be dyed |
| Liquor ratio (material to be dyed: bath) | | = 1:20 |
| Temperature: | | 98° C. |
| Dyeing Duration: | | 60 minutes. |

Formulation B

Identical to Formulation A but containing in addition 4% of hydroxyethane-1,1-diphosphonic acid previously neutralized to pH by the addition of sodium hydroxide solution.

Formulation C

Identical to Formulation A but additionally containing 4% of ethylenediaminetetracetic acid previously neutralized to pH 7 by the addition of sodium hydroxide solution.

After dyeing, samples of the fabric were compared to a sample dyed with distilled water containing no alkaline-earth metals. With respect to the Formulation A, a significant reduction in color transfer was observed as well as a noticeable change in color. However, with Formulations B and C, the coloration corresponded to that of the reference sample dyed in distilled water and little loss in color rendition, if any, was observable. However, the uniformity of color and stability to light of the product obtained with Formulation B was greater than that obtainable with Formulation C.

EXAMPLE 5

In this Example, the dye red active color index 7 was used and was applied under the usual conditions for the dyeing with reactive dyestuffs. The dyes were prepared in distilled water with the following Formulations:

Formulation A: Dyestuff X g/l (X being determined by the weight of the material to be treated to correspond to 2% by weight thereof); NaCl 100 g/l.

After treatment for half an hour at 80° C., 20 g/l of sodium carbonate was added and dyeing was continued for 1 hour at 70° C.

Formulation B: Identical to A but with the addition of 2 g/l of hydroxyethane-1,1-diphosphonic acid previously brought to pH 7 by the addition of caustic soda.

Formulation C: Identical to A but with the addition of 2 g/l of ethylenediaminetetracetic acid previously brought to pH 7 by the addition of caustic soda.

As in Example 1, the sample dyed in accordance with the technique of Formulation B, i.e. in the presence of a diphosphonic acid derivative, shows no modification of color rendition or of stability to light. The use of EDTA in formulation C, however, shows a noticeable change in color and a reduction in the stability to light.

EXAMPLE 6

100% polyester fabric is dyed for sixty minutes at 130° C. with red dispersed dye color index 92 using the following Formulations:

Formulation A: Dyestuff 2% by weight of the material to be dyed;

Acetic acid 2% by weight of the material to be dyed.

Formulation B: Identical to Formulation A but containing in addition 0.1 g/l of copper sulfate.

Formulation C: Identical to Formulation B but containing in addition 4% of a mixture of various polymeric polyphosphates marketed under the name GILTEX N.

Formulation D: Identical to Formulation B but containing in addition 4% of hydroxyethane-1,1-diphosphonic acid previously neutralized to pH 7 with sodium hydroxide solution.

After dyeing, the samples showed a significant clouding or fading of the sample dyed with Formulation B. However, the sample according to Formulation D showed no difference from that of Formulation A, thereby indicating the effectiveness of the diphosphonic acid derivative as a sequestrant for copper. The sample obtained by dyeing with Formulation C also showed significant fading, thereby indicating the ineffectiveness of the polyphosphate in the presence of copper sulfate.

EXAMPLE 7

Dyeing of a polyester/cotton blend of 67% polyester and 33% cotton was carried out using a mixture of blue direct dye color index 86 and red dispersed dye color index 92.

The dyeing regime included an initial stage at 95° C. to ensure transfer of the direct dye and subsequent elevation of the temperature to 120° C. to ensure transfer of the dispersed dye to the polyester. The following Formulations were used:

Formulation A

| | | |
|---|---|---|
| Red dispersed dye color index 92 | 9% | by weight of material to be dyed |
| Blue direct dye color index 81 | 1% | |
| NaCl | 10% | |
| Ammonium sulfate | 1% | |
| Copper sufate | 0.1 g/l. | |

The aqueous solution used the liquor ratio described previously.

Formulation B: Identical to Formulation A but also including 4% of hydroxyethane-1,1-diphosphonic acid previously raised to pH 7 by the addition of sodium hydroxide solution.

Formulation C: Identical to Formulation A but containing 4% of ethylenediaminetetracetic acid neutralized to pH 7 by the addition of sodium hydroxide solution.

Formulation D: Identical to Formulation A but also containing 4% of a mixture of commercial polyphosphates under the mark GILTEX N.

After dyeing the results obtained with the Formulations A–D were compared. The samples treated by Formulations A and D are identical and manifest a normal transfer of the direct dye but a reduction of the transfer of the dispersed dye and a significant fading or clouding thereof. The Formulation C gave the proper results with respect to the polyester dyed by the dispersed dyestuff. However, the color rendition or nuance of the direct dye applied to the cotton was modified and there was a significant drop in the stability to light of the blue color which was formed. Formulation B showed excellent transfer of both dyestuffs without either a modification of the shading and no diminution in the stability of either color to light as compared with a reference sample dyed under the same conditions in the absence of copper sulfide, sulfate and the sequestrant.

Examples 1–7 were each carried out with the following phosphonic acid derivatives with similar results:

the sodium salt of amino-methane-diphosphonic acid;

the sodium salt of amino-bis-methylene-phosphonic acid;

the sodium salt of diethylene-triaminopentakis-methylene-phosphonic acid;

the sodium salt of ethylene-diamine-tetrakis-methylene-phosphonic acid;

the sodium salt of 1-amino-methyl-cyclopentylamino-2-tetrakis-methylene-phosphonic acid;

the sodium salt of 1,2-cyclohexane-tetrakis-methyline-phosphonic acid; and the sodium salt of 1-hydroxypropane-1,1,3-triphosphonic acid.

Furthermore, each Example was tested with each of the phosphonic acids listed above using, however, the potassium and lithium salts with similar effect.

I claim:

1. In a process for the dyeing of textile fibers in an aqueous dyeing bath containing a metal-containing dyestuff sensitive to demetallization by a sequestrating agent at a temperature and for a period sufficient to transfer said dyestuff to said textile fibers, wherein said bath contains at least one sequestrable metal in the form of a metal of said dyestuff, an alkaline-earth metal or a heavy-metal impurity, the improvement which comprises introducing into said bath a sequestrating agent in the form of a hydroxy-($C_1$ to $C_4$)-alkane phosphonic acid salt capable of sequestrating said impurity without affecting the physical-chemical characteristics of said dyestuff, said salt being selected from the group which consists of the sodium, potassium and lithium salts of hydroxyethane-1,1-di-phosphonic acid and 1-hydroxypropane-1,1,3-triphosphonic acid.

2. The improvement defined in claim 1 wherein said dyestuff is selected from the group which consists of:

Color Index red disperse dye 92,

Color Index blue direct dye 86,

Color Index red reactive dye 7

Color Index orange dye 63,

Color Index blue direct dye 81,
Color Index green direct dye 34,
Color Index blue direct dye 93,
Color Index violet direct dye 47, and
Color Index black direct dye 71.

3. In an aqueous bath for the dyeing of textile fibers which contains at least one metal-containing dyestuff sensitive to demetallization by a sequestrating agent and also contains an alkaline-earth or heavy impurity, the improvement which comprises the presence of a salt of hydroxy-($C_1$ to $C_4$)-alkane phosphonic acid as a sequestrating agent, said salt being selected from the group which consists of the sodium, potassium and lithium salts of hydroxyethane-1,1-di-phosphonic acid and 1-hydroxypropane-1,1,3-triphosphonic acid.

* * * * *